United States Patent [19]

Sasamoto et al.

[11] 4,063,505

[45] Dec. 20, 1977

[54] PAPERING APPARATUS IN ROTARY PRINTING PRESS

[75] Inventors: Yoshifumi Sasamoto; Masakazu Iida, both of Yokohama, Japan

[73] Assignees: Ikegsi Iron Works, Ltd.; Ikegai Goss Co. Ltd., both of Tokyo, Japan

[21] Appl. No.: 773,690

[22] Filed: Mar. 2, 1977

Related U.S. Application Data

[63] Continuation of Ser. No. 597,762, July 21, 1975, abandoned.

[51] Int. Cl.[2] ..... B41F 13/06

[52] U.S. Cl. ..... 101/228; 101/181; 226/91

[58] Field of Search ..... 101/222, 223, 248, 220, 101/181, 183; 226/91; 83/407, 408, 404.4, 425.1, 479

[56] References Cited

U.S. PATENT DOCUMENTS

| | | | |
|---|---|---|---|
| 1,971,771 | 8/1934 | Crafts | 226/91 |
| 2,395,950 | 3/1946 | Wolf | 83/407 |
| 3,019,835 | 2/1962 | Engle | 226/91 |
| 3,125,335 | 3/1964 | Becker | 226/91 |
| 3,265,267 | 8/1966 | Wallin | 226/91 |
| 3,363,851 | 1/1968 | Rube | 226/91 |
| 3,399,465 | 9/1968 | Lanne et al. | 226/91 |
| 3,566,729 | 3/1971 | Menn | 83/408 |
| 3,713,649 | 1/1973 | Van Kempen et al. | 226/92 |
| 3,759,434 | 9/1973 | Lindstrum et al. | 226/91 |
| 3,761,001 | 9/1973 | Bolza Schunemann et al. | 226/92 |
| 3,995,553 | 12/1976 | Winterholler et al. | 101/228 |

OTHER PUBLICATIONS

Japanese Patent Office Journal, 1974–3762, 1/28/74.
Japanese Patent Office Journal, 1968–2424, 10/14/68.

*Primary Examiner*—Edgar S. Burr
*Assistant Examiner*—William Pieprz
*Attorney, Agent, or Firm*—Howson and Howson

[57] ABSTRACT

Threading apparatus in a rotary printing press for threading the web through the turning bar. An endless double threading belt is provided along the path of the web through the turning bar. The double threading belt comprises two belts engaged with each other. The web is slit lengthwise into a wider web and narrower web by a slitter located before the turning bar. A side edge of the wider web is nipped in the double threading belt and pulled through the turning bar by the double threading belt during the threading operation so that threading of the wider web through the turning bar is accomplished. After threading the wider web is cut free from the double threading belt. After completion of threading the following full web is cut into equal widths by a slitter. The double threading belt is separated into two belts after threading so that the nipped side edge is removed from the this belt.

7 Claims, 21 Drawing Figures

PAPERING APPARATUS IN ROTARY PRINTING PRESS

This is a continuation of application Ser. No. 597,762 filed July 21, 1975, abandoned.

The present invention relates to threading apparatus in a rotary printing press and particularly to apparatus for threading a cut portion of a full web through a turning bar.

In many rotary printing presses a full web of paper is printed with a plurality of pages extending transversely across it, and the web is automatically slit longitudinally as it passes through the machine to separate said pages transversely from each other. It is then also generally desirable to bring the separated strips or partial webs into confronting alignment with each other by the time they reach the former, so that the pages of the newspaper or the like will be properly aligned when cut and folded by the former. This is usually accomplished by passing the slit web portion to be moved sideways through a turning bar section. A problem with such machines lies in the initial threading of the web through the machine. To accomplish threading, it is known to clip or to temporarily secure a tip formed at one edge of the full web into a slit in an endless guide belt by a manual operation, this belt then being driven to pull the full web through the printing couple and to leave the straight partial web to the former. Threading of the other ("barred") web portion through the turning bar section has been done manually, by skilled operators working near the top of the press, with accompanying starting and stopping of the machine. This is time-consuming, requires skilled hands, and is rather dangerous because of the location in which the work must be done. Even if an endless threading belt having a plurality of slits in it is provided along an edge of the path of the web in the turning bar sometimes also known as papering section, and the leading corner or tip of the web inserted into the one of slits and threaded through the turning bar by moving the threading belt at the same speed as the threading speed of the rotary press, the tip of the web must be inserted into the slit by hand. Accordingly the rotary printing press must be stopped before this threading operation which results in decrease of operational efficiency. Further, the web must be removed from the threading belt by hand after completion of the threading. Therefore the operator must carefully monitor the threading operation from the beginning to end. Illustrative of prior art in this area are Japanese Patent Office Journal 1974-3762, published Jan. 28, 1974, and Japanese Patent Office Journal 1968-2424, published Oct. 14, 1968.

Therefore it is an object of the present invention to provide a threading apparatus which may automatically perform the threading through the turning bar without requiring stopping of the machine and manual operations.

In accordance with the present invention, the full web is cut in two webs of different width by a first slitter, operating along a first longitudinal cutting line and a side edge or margin of the wider cut web is nipped in a double threading belt which comprises two belts capable of being engaged with each other along their lengths to nip the web margin between them. The threading is performed by automatic movement of the double threading belt. After the threading, the following full web is cut into two webs having equal widths by a second slitter, operating along a second longitudinal cutting line and cut off from the double threading belt. Cutting lines formed by both of said slitters are joined by cutting the web transversely between both lines.

Other and further objects, features and advantages of the present invention will appear from the following description taken in connection with accompanying drawings, wherein.

Figure 7:
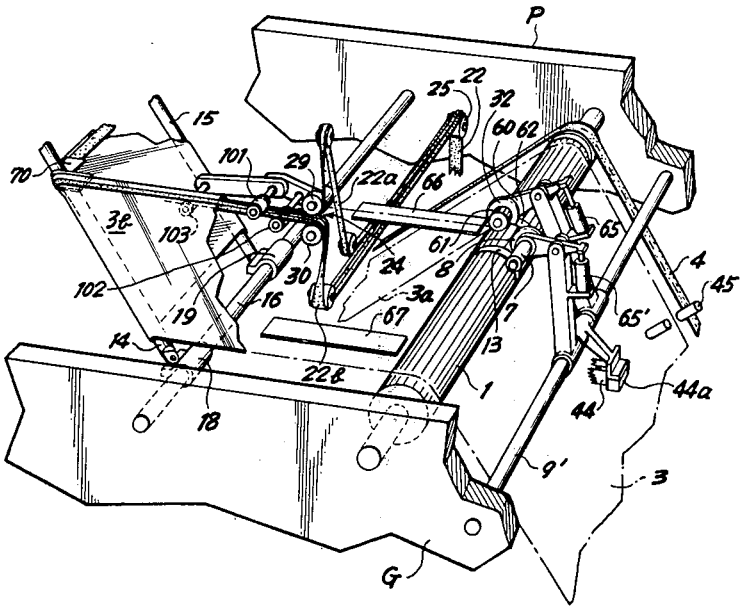
Figure 8A:
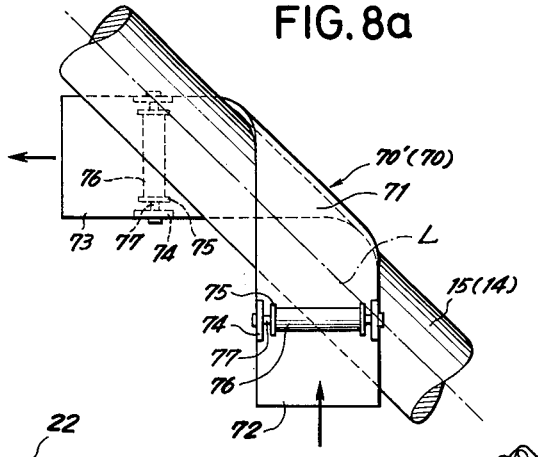
Figure 8B:
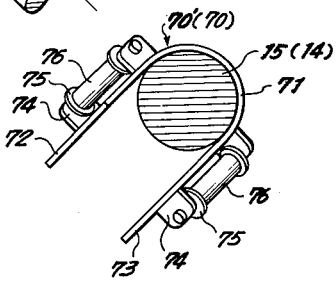

FIGS. 5*a* to 5*e* are sectional views showing various double threading belts;

FIGS. 6*a* to 6*d* are plan views showing the process of cutting the web;

FIG. 7 is a perspective view showing another embodiment of the present invention;

FIG. 8*a* is a plan view showing means for guiding a threading belt through a turning bar;

FIG. 8*b* is a sectional view of the guide means of FIG. 8*a;*

Figure 9:
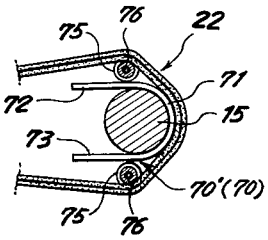
Figure 10A:
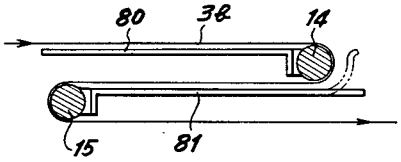
Figure 10B:
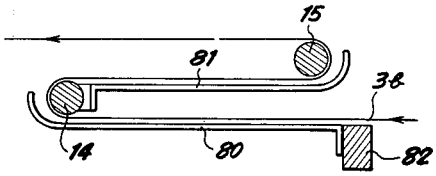
Figure 11A:
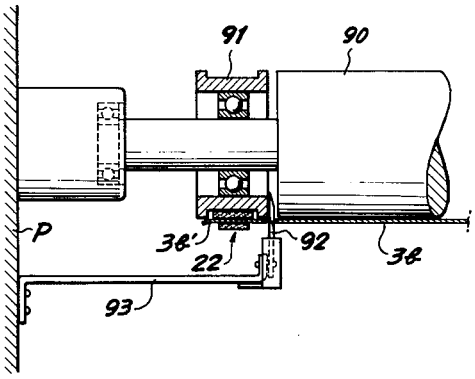
Figure 11B:
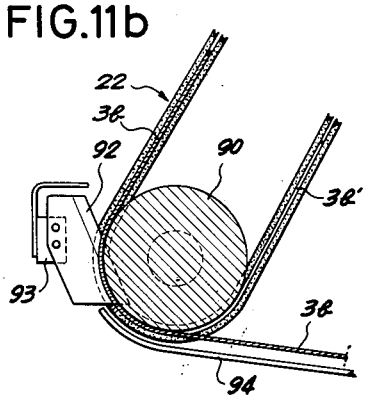

FIG. 9 is a sectional view showing the guide means with which the threading belt is engaged;

FIGS. 10*a* and 10*b* are sectional side views of a turning bar section;

FIG. 11*a* is a side view showing means for cutting off the side edge of the web; and FIG. 11*b* is a sectional view of the cutting means illustrated in FIG. 11*a*.

Figure 1:
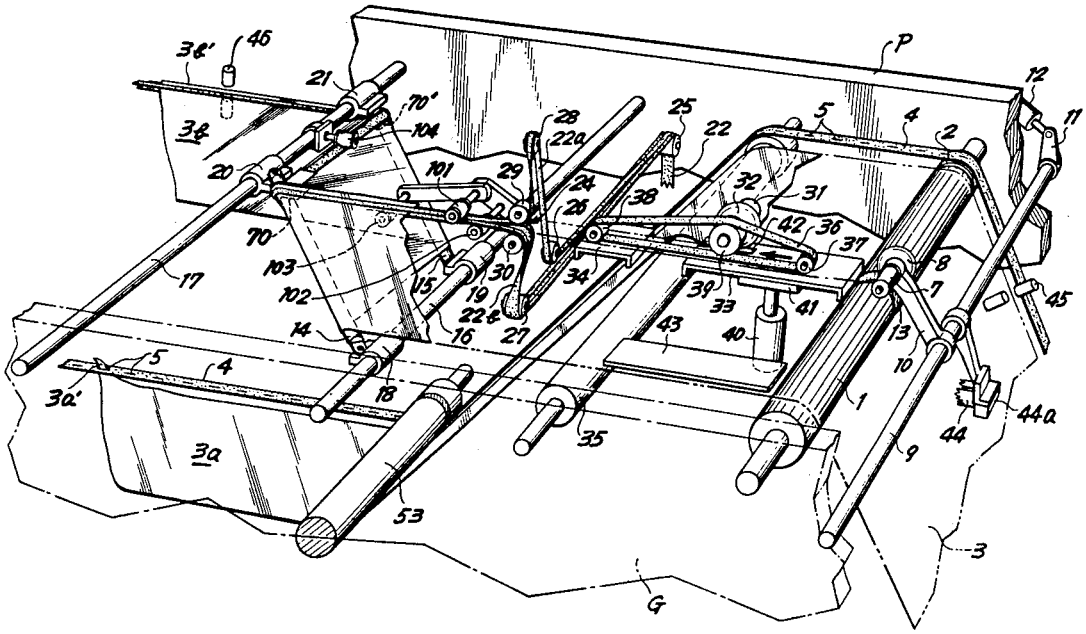
FIG. 1 is a perspective view of apparatus for accomplishing threading through a turning bar according to the present invention.
Figure 2:
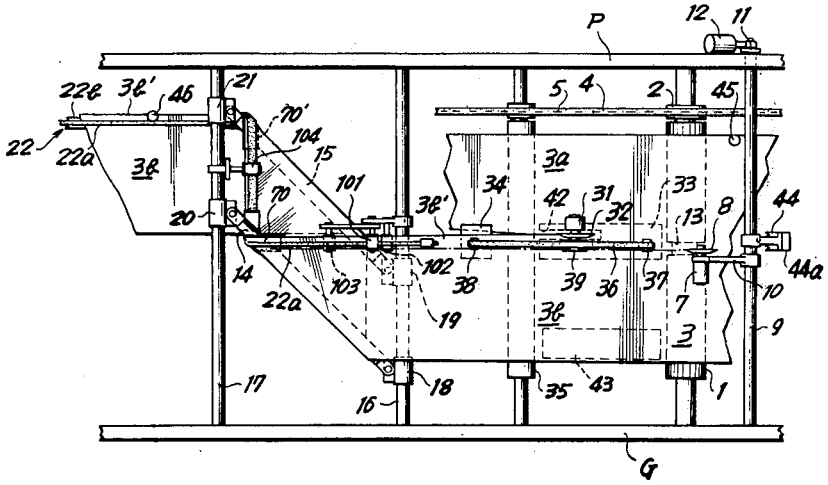
FIG. 2 is a plan view of the papering apparatus illustrated in FIG. 1.
Figure 3:
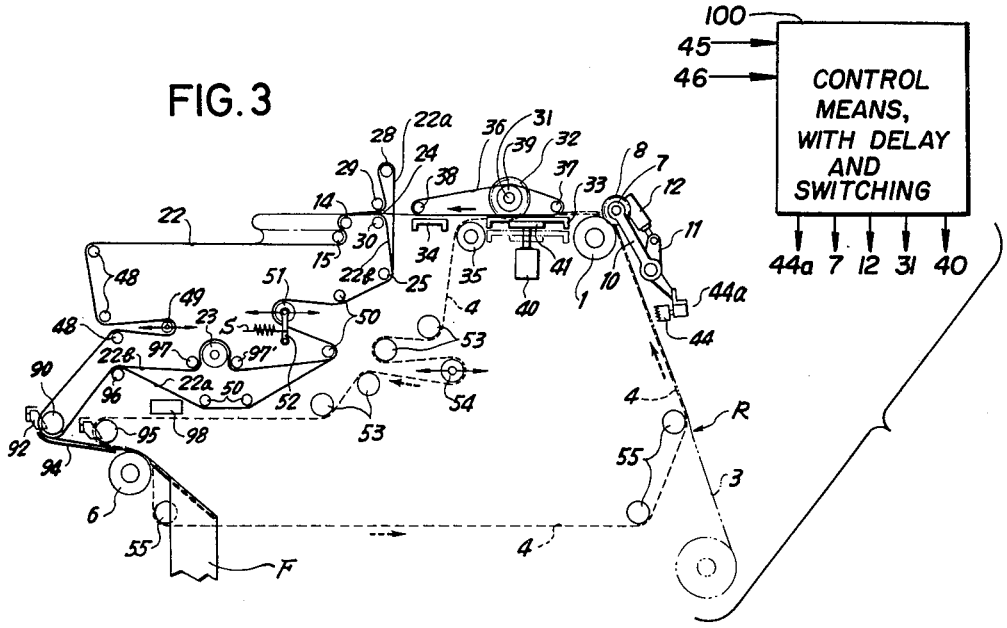
FIG. 3 is a side schematic side view showing a path of the web.

Referring to the drawings and more particularly to FIGS. 1 and 2, numeral 1 designates a drag roller which is journaled in bearings provided in side frames G and P and driven to rotate in synchronism with the speed of the rotary printing press for drag of a full width web (for example, four pages newspaper width of web). An endless papering belt 4 passes over a pulley 2 secured to the end of the drag roller 1. The belt 4 has a plurality of slits 5 over all length thereof. The tip end of the web 3 is inserted into one of the slits 5. As shown in FIG. 3, the papering belt 4 passes along the path of the web and passes over the drag roller 1 and various other rollers including the drag roller 6 preceding the former F and also passes through the web extracting section R containing the supply roll of paper.

A standard size cutting slitter 8 rotated by a motor 7 is supported on the end of an arm 10 secured to the shaft 9 which is rotatably mounted on the frames G and P. The slitter 8 serves, when actuated, as a knife to cut the web 3 along its center line into two webs 3*a* and 3*b* after the time at which threading through the turning bar section has been completed, as mentioned hereinafter. Secured on the outer end of the shaft 9 is an arm 11 of which the end is rotatably connected to the piston rod of hydraulic cylinder 12 provided on the side of the frame P. Thus, operation of the hydraulic cylinder 12 causes the shaft 9 to rotate so that the slitter 8 is inserted into the circumferential cutting groove 13 provided on the drag roller at the central position thereof.

Turning bars 14 and 15 are to shift the web 3*b* to the position of the web 3*a*, i.e. with the edges of web 3*b* aligned with the edges of web 3*a* and plane parallel thereto. To this end, both turning bars are mounted on brackets 18, 19, 20 and 21 which in turn are mounted on supporting bars 16 and 17. Each turning bar is positioned at a 45° angle to the direction of travel of the web. In accordance with the invention, there is also provided a double threading belt 22 extending along the path of the web 3*b* at the cut side thereof. As shown in FIG. 3, the double threading belt 22 is separated into the belts 22*a* and 22*b* at a belt driving section, where the belt 22*b* passes over the driving pulley 23 for driving thereof. The driving pulley 23 is rotated through a transmission device (not shown) including a clutch, at the same speed as the threading speed of the rotary printing press. Further, the double papering belt 22 is divided into upper and lower belts at the nipping section 24 adjacent to the entrance to the turning bars for nipping the inner marginal or side edge 3*b*′ of the web 3*b* which is formed by cutting the web 3 with a slitter 32 in wider size than the web 3*a* as described hereinafter. More particularly, the double threading belt passes over the pulley 25 and is separated into two belts 22*a* and 22*b* by pulleys 26 and 27 as shown in FIG. 1. The belt 22*a* passes under the pulley 26 and the belt 22*b* passes under the pulley 27 so that both belts are thereby upwardly directed. The belt 22*a* then passes over a pulley 28 by which it is downwardly directed and next passes under the pulley 29 the axis of which is directed at right angles to the axis of the pulley 26 so that the belt then travels in the direction parallel to the motion of the web. The other belt 22*b* also passes over the pulley 30 adjacent to the pulley 29 and arranged in the same orientation as a pulley 29 so that the belt 22*b* is arranged in the position aligned with and closely confronting the belt 22*a* and travelling parallel thereto. Thus the nipping section 24 is formed between belts 22*a* and 22*b* at the entrance of the turning bars 14 and 15 for nipping the cut side edge 3*b*′ of the web 3*b* as described hereinafter.

Figure 5A:
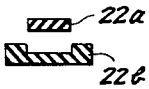
Figure 5B:
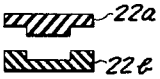
Figure 5C:
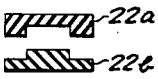
Figure 5D:
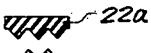
Figure 5E:
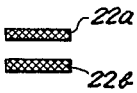

The double belt 22 shown in FIG. 5*a* comprises a component belt 22*a* which can be engaged with the groove of the other component belt 22*b* when pressed into it to form the double belt 22. Each belt 22*a* of FIGS. 5*b* and 5*c* has a projection which may be pressed into and thereby engaged with the groove provided in another belt 22*b*. The belts 22*a* and 22*b* illustrated in FIG. 5*d* are engaged with each other by longitudinal projections. Belts 22*a* and 22*b* of FIG. 5*e* are magnetized to attract each other. Each type of double belt 22 obviously may be repeatedly separated into its two component belts and pressed together again to reform the double belt.

In the nipping section 24, pulleys 101 and 102 are provided to engage the belts 22*a* and 22*b* with each other with the cut web edge 3*b*′ nipped between them. Thus a V-shaped introducing port is formed at 24 to receive and nip edge 3*b*′. The engaged double belt 22 next passes over the pulley 103, around the turning bar 14, under the pulley 104 and around the turning bar 15 while maintaining the engagement of the belts 22*a* and 22*b* with each other, so that the side edge 3*b*′ nipped between belts 22*a* and 22*b* passes through the turning bar section without departing from the desired path of the web 3*b*. The mill edge of the web 3*b* exiting from the turning bars is thereby properly aligned.

Threading belt guiding plates 70 and 70′ are provided around the turning bars 14 and 15 respectively. As shown in FIGS. 8*a* and 8*b* each guiding plate comprises a cylindrical portion 71 coaxial with the center line L of the turning bar and flat portions 72 and 73. On each flat portion is provided a guiding roller which comprises a roller 76 having flanges 75 and shafts 77 which are rotatably supported by a pair of brackets 74. The roller serve as a guide over which the papering belt 22 passes, so that the papering belt 22 may be passed over the cylindrical portion 71 with small contacting area. Accordingly, it is preferable to provide the roller at the position near the cylindrical portion 71 as shown in FIG. 9. Further, it is useful to provide a crowning on the periphery of the rollers 76, 76 for guiding the papering belt 22. Referring to FIG. 10*a*, in order to guide the opposite or mill side of the web 3*b*, a guide plate 80 is secured to the turning bar 14 and a guide plate 81 is secured to the turning bar 15. It is preferable to bend the end of the guide plate 81 about the turning bar 14 as shown by dotted line, so that the portion of the web 3*b* remote from the nipped edge is guided around the turning bar 14. In the device of FIG. 10*a*, the web 3*b* is passed through the turning bar from the higher to the lower bar. If instead the relative heights of the bars are reversed and the web is passed from the lower bar to the higher bar, the guide plate 80 is mounted on the bar 82 secured to the frames P and G and the guide plate 81 is secured to the turning bar 14 as shown in FIG. 10*b*. In the latter case the end of each guide plate is bent about the turning bar.

The slitter 32 is mounted on a frame (not shown) and rotated by a motor 31 to slit the web 3 into the two webs 3*a* and 3*b* of which web 3*b* is wider than 3*a* by the width of the double threading belt 22, when threading is to be accomplished. Between the drag roller 1 and the nipping section 24 there is provided a guide plate 33 which is adapted to hold the web 3 at the central portion thereof, and also provided is a guide plate 34 which serves to hold the web 3*b* at the side edge 3*b*′. Between the guide plates 33 and 34 there is provided a guide roller 35 which acts to guide the web 3*a*.

In order to assist in transferring the web 3 from the drag roller 1 to the nipping section, there is provided a web feeding belt 36 positioned above the guide plates 33 and 34 and brought into frictional engagement with the top of web 3 and with the web 3*b* after slitting by the slitter 32. The web feeding belt 36 is arranged in an endless loop, and passes over pulleys 37 and 38 and a driving pulley 39 provided on the shaft of the slitter 32, in such manner that the web feeding belt is driven at the same speed as the web. It will be seen that the web feeding belt 36 may be passed over a separate pulley (not shown) coaxial with the pulley 29 and driven by the separate pulley without requiring the driving pulley 39.

The guide plate 33 is mounted on the plate 41 which is secured to the rod of hydraulic cylinder or electromagnetic solenoid 40 so that the guide plate 33 may be raised or lowered by the operation of the electromagnetic solenoid. The guide plate 33 has a slit 42 into which the cutting edge of the slitter 32 extends when the guide plate is raised. There is further provided a guide plate 43 between the drag roller 1 and the guide roller 35 near the side frame G so that the 3*b* side of the web 3 is supported.

Figure 4:
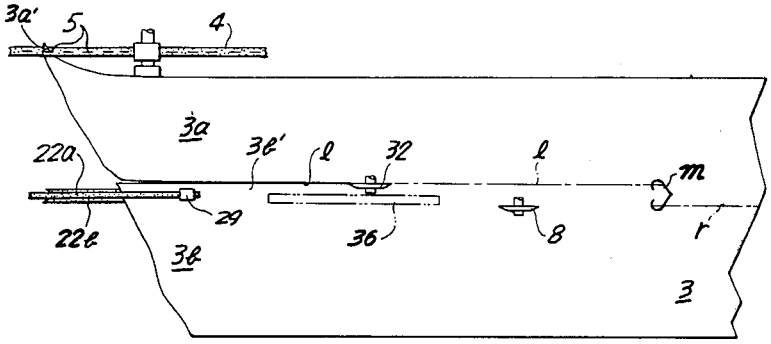
FIG. 4 is a plan view showing a cutting of the web.

Referring to FIG. 4, the web 3 is cut along the cutting line *l* by the slitter 32 into the narrower web 3*a* and the wider web 3*b* during the procedure for threading the web 3*b* through the turning bar section. When this threading is completed the web 3 is cut along the cutting line *r* by the slitter 8 into two equal width webs. In this cutting, it is necessary to join the cutting line *l* to the cutting line *r*. To this end, the web between the lines *l* and *r* is cut transversely by a cutter 44, as shown by cutting line *m*. The cutter 44 is mounted on the arm secured to the shaft 9 and adapted to be operated by an electromagnetic solenoid 44*a*. The cutting is caused by rotation of the shaft 9 and energization of the solenoid 44*a* before the cutting by the slitter 8. The cutter 44 is retracted immediately after the cutting by deenergization of the solenoid 44*a*.

The actuations of the slitter 32, cutter 44 and slitter 8 are controlled by control means, so that cutting lines *l*, *m* and *r* are continuous with each other. To this end, a web detecting device 45 such as a photoelectric detecting device is provided before the drag roller 1 to emanate a signal of arrival of the web. Upon receiving of the signal the control means generates signals to initiate movement of the threading belt 22, rotation of the slitter 32, movement of the paper feeding belt 36 and upward movement of the guide plate 33. There is also provided a web detecting device 46 such as a photoelectric detecting device 46 positioned after the supporting bar 17 for the turning bars 14 and 15 to generate a signal of arrival of the side edge 3*b*′ of that web 3*b*. Upon receipt of the signal the control means operates to actuate the solenoid 44*a* for actuation of the cutter 44, so that the web 3 is cut at the cutting line *m*. At the same time a delay circuit is operated for generating a delayed signal after a predetermined time. The delayed signal from the delay circuit causes the slitter 8 to operate to cut the web 3 so as to join the cutting line *m* to the line *r*. Thereafter the guide plate 33 is lowered, the slitter 32 and web feeding belt 36 are stopped. Since the elements for accomplishing this timed switching means may be entirely conventional in themselves, they are shown in block form in FIG. 3 as control means 100, which includes appropriate delay means and switching means, with input connections from detecting devices 45 and 46 and outputs to cutter solenoid 44*a* for forming the transverse cut, to motor 7 and cylinder 12 for controlling operation of the slitter 8, and to motor 31 and solenoid 40 for controlling operation of the slitter 32 with appropriate timing, as fully described herein. Other conventional controls may be used to control other parts of the systems.

In the present embodiment, the side edge 3*b*′ of wider web 3*b* must be cut off from the web 3*b* before it reaches former F. The cutting is performed by a cutter 92 which is secured to a bracket 93 mounted on the frame P as shown in FIG. 11*a*. The cutting edge of cutter 92 extends between the guide roller 90 and the guide pulley 91 which is rotatably mounted on the shaft of the guide roller 90 for guiding the double threading belt 22. Thus the side edge 3*b*′ of the web 3*b* is cut off by the cutter 92 before the former F, which means remove of the web 3*b* from the double papering belt. Between the guide roller 90 and the drag roller 6, there is provided a plate 94 for supporting the portion of web 3*b* released from the papering belt 22. The tip end 3*a*′ of the web 3*a* inserted in the slit 5 of the threading belt 4 is cut off by a cutter provided in the location adjacent to the guide roller 95 in the same manner as the above-described cutting off of side edge 3*b*′.

The side edge 3*b*′ nipped between the belts 22*a* and 22*b* must be removed from the belts after cutting off from the web 3*b*. To this end the belt 22 is divided into the belts 22*a* and 22*b* by pulleys 96, 97 and 50 as shown in FIG. 3, so that the detached side edge 3*b*′ falls into box 98.

The belt 22*b* is held in high friction engagement with the driving pulley 23 by the pulleys 97 and 97′. Thus the belt is driven at the same speed as the threading speed without slipping of the belt on the driving pulley.

Referring to FIG. 3, after passing through the turning bars the double threading belt 22 passes over guide rollers 48 and register roller 49 which is adjusted in conventional manner to adjust longitudinally the web 3*b* with respect to the web 3*a*. Numerals 50 are guide pulleys and 51 is a spring biased tension pulley. The tension pulley 51 is provided on the end of a rocker arm 52 pivotally mounted on the frame P and urged by spring S to tension the belt 22. Numerals 53 are guide rollers for the web 3*a* provided with a pulley for the threading belt 4 at one end thereof. 54 is a register roller for conventionally adjusting the web 3*a* to the web 3*b*. Numerals 55 are guide pulleys for the main threading belt 4, 51′ is a belt-tensioning pulley and 23′ is the drive pulley for belt 4.

Operation of the above described apparatus of the present invention will now be described.

Before threading, the slitter 8 is located in the retracted position above the drag roller 1. The slitter 32, web feeding belt 36 and double threading belt 22 are stopped respectively, and the guide plate 33 is lowered in the retracted position. The leading end of web 3 is cut into a triangular shape and rolled diagonally to form a protruding tip which is inserted into one of slits 5 of the single threading belt 4 as shown in FIG. 4. The rotary printing press is driven at the papering speed (10 m/min), thereby the web 3 is pulled by the single threading belt 4 through the printing unit PR. When the lead, end of the web reaches the detecting zone of the web detecting device 45, a single is generated from the device. The motor 31 is started by this single so that the slitter 32 and belt 36 are driven in the direction shown by the arrow in FIG. 3. At the same time, the driving pulley 23 for the double belt 22 is driven through an electromagnetic clutch so that the double threading belt 22 is driven. In addition the cylinder or electromagnetic solenoid 40 is energized to project the guide plate 33 upwardly against the belt 36. Thus the cutting edge of 32 is inserted into the slit 42 of the guide plate 33.

Figure 6A:
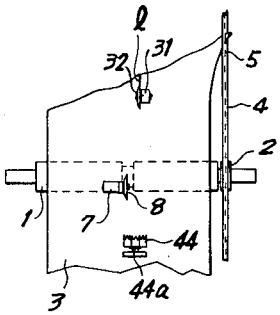
Figure 6B:
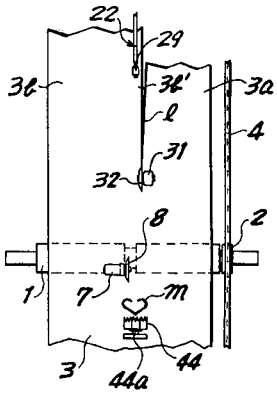

After passing over the drag roller 1, the web 3 is carried by the belt 36 and cut by the slitter 32 along the line 1 shifted off-center toward the side frame P as shown in FIG. 6*a*. That is during threading the width of the web 3*a* is smaller than the standard one-half of the full width and the width of the web 3*b* is larger than the standard one-half of the full width of the web by an amount substantially equal to the width of the papering belt 22. The web 3*a* passes over the guide roller 35 along with the papering belt 4 and then passes through rollers 53, 95 and drag roller 6 as shown in FIG. 3. The web 3*b* is carried by the belt 36 on the guide plate 34 and lead into the nipping section 24 between the belts 22*a* and 22*b*. Belts 22*a* and 22*b* are forced to engage or mesh with each other by pulleys 101, 102 and 103, whereby the side edge 3*b*′ of the web 3 is nipped within the double belt and introduced into the turning bar section. The threading belt 22 passes over pulleys 76 at the turning bars 14 and 15 without contacting the flat portions 72 and 73 of the guide plate 70 and 70′ as shown in FIG. 9. Thus the contacting area of the belt 22 with guide plates 70 and 70′ may be decreased so that frictional resistance of the belt to the guide plates may be decreased. The threading belt 22 is prevented from shifting laterally by the flanges 75 of each roller 76 during passing through the turning bar.

Thus the web 3*b* is pulled by the double threading belt 22 and threaded through the turning bar with the support of plates 80 and 81.

Figure 6C:
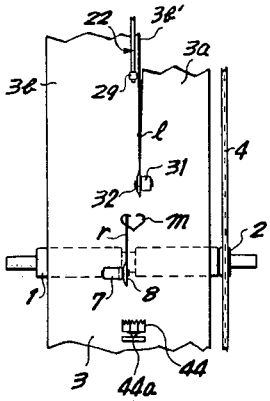
Figure 6D:
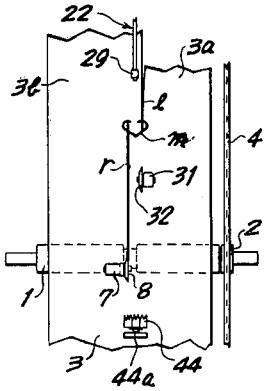

After passing through the turning bar section the web 3*b* is detected by the detecting device 46, which results in energization of the solenoid 44*a*. Thus the cutter 44 is actuated to cut the web 3 at the cutting line *m* which provides a transverse cut to connect the line *l* cut by the slitter 32 with line *r* cut by the slitter 8 as shown in FIG. 6*d* and described hereinafter. After cutting, the cutter 44 is retracted to the initial position by a not shown spring. Since the cutter 44 has a heart shape and the web is cut by the V-shaped tip of the cutter, the running web may be cut without breaking of the paper about the line *m*.

When the cut portion *m* reaches to the position under the cutter 8, the motor 7 is driven by the signal from the detecting device 46 as mentioned above. After a predetermined lapse of time the cylinder 12 is actuated to rotate the shaft 9 so that the slitter 8 provided on the arm 10 is inserted into the groove 13 of the drag roller 1. Accordingly the web 3 is thereafter cut into the webs 3*a* and 3*b* having equal width, along the cutting line *r*. The cutting of the slitter 8 is started from the left shoulder of the cut line *m* thereby the lines *m* and *r* are connected with each other as shown in FIG. 6*c*. Thereafter the cut line *m* reaches to the position under the slitter 32 where the cut line *l* is connected to the cut line *m* at the right shoulder. At the same time, the solenoid 40 is energized to lower the guide plate 33, and the slitter 32, driving pulley 39 and belt 36 are stopped respectively. Thus cutting with the slitter 32 is no longer performed and the webs 3*a* and 3*b* having equal width pass through respective paths. Each of the cut lines *l* and *r* crosses twice the cut line *m* at the shoulder portion. Therefore, timing error in the actuation of the slitters 32 or 8 is permitted, if the error is of small amount.

The side edge 3*b*' of the web 3*b* is cut off by the cutter 92 at the guide roller 90. After this cutting the web 3*b* is held by the guide plate 94 and passes over the drag roller 6 and is carried to the former F. The side edge 3*b*' cut off from the web 3*b* is further carried by the papering belt 22 and passes over the guide pulley 96. The double threading belt 22 is divided into the belts 22*a* and 22*b* by the pulleys 50 and 97 after passing over the pulley 96 so that the cut off side edge 3*b*' is released from the belt 22 and falls into the box 98. The tip 3*a*' cut off from the web 3*a* is removed from the belt 4 by operator at a proper station. Thereafter the papering belts 4 and 22 are stopped.

It is possible to construct the apparatus so that the guide plate 33 remains stationary while the slitter 32 and papering belt 36 are raised and lowered. Further, it will be understood that slitters 8 and 32 and the feeding belt 36 may be connected to the driving means of the rotary printing press through electromagnetic clutches and driven by energizing the electromagnetic clutches.

In the apparatus of FIG. 7, the guide roller 35, belt 36 and guide plate 33 of above described embodiment are omitted and the slitter 32 is provided above the drag roller 1 so that the nipping section 24 is located near the drag roller 1. The slitter 32 is rotatably mounted on the arm 60 together with a nipping roller 61. Accordingly, when the nipping roller 61 is pressed on the drag roller 1, the nipping roller 61 and slitter 32 are rotated and thereby the web 3 is pulled. The slitter 32 is adapted to be inserted into the groove 62 of the drag roller 1 by actuation of the electromagnetic solenoid 65. The slitter 8 rotated by the motor 7 is also inserted into the groove 13 of the drag roller by operation of the electromagnetic solenoid 65'. There are provided guide plates 66 and 67 between the drag roller 1 and the nipping section 24 for supporting the web 3*b*. Other parts are the same as the previously described embodiment and same references are used for indicating the same parts as the previous one. In this embodiment, operation of the slitter 32, cutter 44 and slitter 8 and the general sequence of each operation are the same as in the preveiously described embodiment, although the time between operations is modified in an obvious manner to accommodate the changed position of slitter 32, i.e. the delay between the starting of sorter A and the stopping of slitter 32 is appropriately reduced.

The present invention has following advantages.

1. In accordance with the present invention, during threading the web portion to be "barred" by passing through turning bars is cut wider than during post-threading operation of the press, to provide a web margin which is automatically nipped in the double threading belt at the nipping portion where the double threading belt is opened in a V-shape. Accordingly, it is not necessary to stop the machine for nipping the web in the papering belt unlike the prior art practice in which the machine is stopped to enable manual threading of the barred web through the turning bars and into proper alignment with the straight or unbarred portion of the web prior to delivery of both to the former.
2. Since there are provided a guide plate and web feeding belt between the full-web drag roller and the nipping section preceding the turning bar section, the web portion to be barred may be carried to the nipping section even if the nipping section is located at a distance substantial from the drag roller.
3. Since the side edge of the barred web portion is securely nipped in the double threading belt, the web is not in danger of accidentally releasing from this threading belt.
4. Since the double threading belt leads the barred portion of the web from the turning bar to a portion near the entrance to the former along the proper path, deflection of the web from this path and breaking of the web are prevented.
5. Although the original full web is slitted into two webs having different widths during threading, the web is slitted in equal widths by a continuous cutting line after threading.
6. Since the side edge or margin of the barred web which is nipped in the double threading belt is automatically cut off by the cutter after papering, it is not necessary to break off this side edge by hand.
7. The barred web separated from the double threading belt is carried on the guide plate and guided to the subsequent drag roller without loosening or slacking.
8. The cut off side edge nipped in the double threading belt is automatically removed from the belt, because the double belt is separated into two belts in the return path of the belt.

Thus the threading of the barred web portion is fully automatically performed.

While the present invention has been described in its preferred embodiments, it is to be understood that the invention is not limited to the embodiments thereof.

What is claimed is:

1. In printing press apparatus of the class in which a web of printed paper is moved from a printing section through a slitting section to a former, said slitting section comprising first slitter means for slitting said web longitudinally into two partial webs of equal widths one of which partial webs is passed through a turning-bar section on its way to said former so that both said partial webs are in laterally-aligned superposed relation with each other upon reaching the former, means for accomplishing initial threading of said one partial web through said turning-bar section, comprising:

controllable second slitter means in said slitting section for slitting said web longitudinally into two partial webs of different widths, the wider of said partial webs of different widths being the one which is to be threaded through said turning-bar section;

endless double-threading-belt means and means for driving said double-threading belt means along the path of the margin of the slit edge of said wider partial web from the entrance to said turning-bar section through said turning-bar section to said former, said belt means grasping said margin of said wider partial web and threading said wider partial web through said turning-bar section into proper laterally-aligned superposed relation with the narrower of said partial webs of different widths, said double threading-belt means comprising two component belts which are separable to form a nipping section for receiving said margin of said wider partial web and which are reclosable to each other to nip said margin between them and accomplish said grasping thereof;

controllable transverse cutter means for producing a transverse cut extending between the longitudinal line of slitting of said first slitter means and the longitudinal line of slitting of second slitter means; and control means for controlling the timing of operation of said first and second slitter means and of said transverse cutter means such that said second slitter means operates on the leading portion of said web to divide it into said two partial webs of different widths until the slit formed by it intersects said transverse cut, and said first slitter means operates to form a longitudinal slit dividing said web into said two partial webs of equal thickness beginning at said transverse cut and continuing thereafter during the subsequent normal operation of said press, whereby the slits formed by said first and second slitter means are joined by said transverse cut to form a single continuous slit.

2. The apparatus of claim 1, comprising a web guide plate and an endless feeding belt in closely-confronting relation to each other both located ahead of said nipping section along the path of said wider partial web and positioned to receive said wider partial web between them, said feeding belt moving across said plate in the direction toward said nipping section in frictional engagement with said wider partial web to feed said wider partial web into said nipping section.

3. The apparatus of claim 1, comprising means for cutting-off said margin of said wider partial web after it passes through said turning bar means, whereby said wider partial web is disengaged from said double threading-belt means, and means for subsequently separating said double threading-belt means into its component belts to release said cut-off margin portion from said double threading-belt means.

4. The apparatus of claim 1, wherein said double threading-belt is an endless belt means.

5. The apparatus of claim 1, wherein said control means comprises means for sensing when said wider partial web has passed through said turning bar section to produce a signal indicative thereof, and means for delaying said signal and for applying said delayed signal to control operation of said cutter means and said first slitter means and second slitter means.

6. The apparatus of claim 1, wherein the periphery of said transverse cut crosses each of said longitudinal lines of slitting at least at two longitudinally spaced-apart points thereby to reduce the accuracy required in controlling the operations of said first and second slitter means and of said transverse cutter means.

7. The apparatus of claim 6, wherein said transverse cut is generally heart-shaped with its axis lying generally parallel to the lines of said longitudinal slitting.

* * * * *

UNITED STATES PATENT OFFICE

CERTIFICATE OF CORRECTION

PATENT NO. : 4,063,505

DATED : December 20, 1977

INVENTOR(S) : Yoshifumi Sasamoto et al

It is certified that error appears in the above-identified patent and that said Letters Patent are hereby corrected as shown below:

[73] Assignees: "Ikegsi Iron Works, Ltd.; Ikegai Goss Co. Ltd." should read --Ikegai Iron Works, Ltd.; Ikegai Goss Co. Ltd. --

[75] Inventors: Yoshifumi Sasamoto; Masakazu Iida, both of "Yokohama", Japan should read --Yokohamashi--.

Column 2, line 62, --when slitting is desired-- should be inserted before the period at the end of the line.

Column 2, line 63, "to shift" should be deleted and --for the conventional purpose of shifting-- should be inserted.

Column 7, line 42, "papering" should read --double-threading--.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*